US006584633B2

(12) United States Patent
Chute et al.

(10) Patent No.: US 6,584,633 B2
(45) Date of Patent: Jul. 1, 2003

(54) AUTOMATED FRAGRANCE APPLICATION APPARATUS AND METHOD

(75) Inventors: Brian Chute, Inver Grove Heights, MN (US); Charles A. Hodge, Cottage Grove, MN (US); Richard J. Mehus, Richfield, MN (US); Peter W. Rauen, Cottage Grove, MN (US); Thomas L. Hennemann, Winston-Salem, NC (US); William Crawford, Eden Prairie, MN (US); Paul Mattia, Prior Lake, MN (US)

(73) Assignee: Ecolab Inc., St. Paul, MN (US)

( * ) Notice: Subject to any disclaimer, the term of this patent is extended or adjusted under 35 U.S.C. 154(b) by 167 days.

(21) Appl. No.: 09/735,395

(22) Filed: Dec. 12, 2000

(65) Prior Publication Data

US 2002/0069465 A1 Jun. 13, 2002

(51) Int. Cl.[7] ..... D06B 1/02
(52) U.S. Cl. ..... 8/158; 68/19.1; 68/20
(58) Field of Search ..... 8/158, 149.2; 68/12.02, 68/12.18, 13 R, 19.1, 20

(56) References Cited

U.S. PATENT DOCUMENTS

| | | | | |
|---|---|---|---|---|
| 3,659,352 | A | | 5/1972 | Cook |
| 3,861,865 | A | | 1/1975 | Grantham |
| 3,980,203 | A | | 9/1976 | Dearling |
| 4,015,930 | A | | 4/1977 | Grantham |
| 4,065,261 | A | | 12/1977 | Fukada |
| 4,171,280 | A | * | 10/1979 | Maddox et al. |
| 4,341,348 | A | | 7/1982 | Dearling |
| 4,594,239 | A | * | 6/1986 | Pluim, Jr. |
| 4,889,755 | A | * | 12/1989 | Charbonneau |
| 4,925,517 | A | * | 5/1990 | Charbonneau et al. |
| 5,038,972 | A | | 8/1991 | Muderlak et al. |
| 5,074,438 | A | | 12/1991 | Ingram |
| 5,126,078 | A | | 6/1992 | Steiner et al. |
| 5,221,025 | A | | 6/1993 | Privas |
| 5,230,837 | A | | 7/1993 | Babasade |
| 5,534,105 | A | | 7/1996 | Boyd |
| 5,592,750 | A | | 1/1997 | Eichten |
| 5,610,674 | A | | 3/1997 | Martin |
| 5,611,486 | A | | 3/1997 | Paul |
| 5,840,668 | A | * | 11/1998 | Behan et al. |
| 5,924,597 | A | | 7/1999 | Lynn |
| 6,010,540 | A | * | 1/2000 | Telesca et al. |
| 6,153,571 | A | * | 11/2000 | Komaocki et al. |
| 6,220,267 | B1 | * | 4/2001 | Joshi |

FOREIGN PATENT DOCUMENTS

| | | |
|---|---|---|
| EP | 0 676 497 B1 | 9/1999 |

* cited by examiner

*Primary Examiner*—Frankie L. Stinson
(74) *Attorney, Agent, or Firm*—Merchant & Gould P.C.

(57) ABSTRACT

A method and apparatus provide for an automated fragrance dispenser for the application of a fragrance to dry fabrics during an industrial laundering process. In one embodiment, the fragrance dispenser is positioned outside the dryer, and preferably on the exit side of the steam tunnel in the laundering process. The fragrance dispenser includes a sensor for determining whether the garment passing on the conveyor is the type of garment to which the fragrance is to be applied, for example, a uniform shirt versus pants. The fragrance dispenser also includes a delivery system for applying the fragrance to selected garments. The delivery system also includes a timing device for dispensing the fragrance onto the garment for a controlled amount of time.

In an alternative embodiment of the present invention, automated application of the fragrance to fabrics is provided in the dryer within the laundering process. The fragrance dispenser according to this embodiment includes a product media located in the air intake environment of the dryer, and a delivery system for applying the fragrance to the product media. The delivery system is configured to apply the fragrance to the product media, via an air-injection spray nozzle, during the cooling cycle of the dryer. The operation of the dryer draws air through the product media, thereby applying fragrance to the garments in the rotating drum of the dryer.

47 Claims, 15 Drawing Sheets

AUTOMATED FRAGRANCE APPLICATION APPARATUS AND METHOD

FIELD OF THE INVENTION

This invention relates to apparatus and methods for automated application of fragrance to fabrics during industrial laundering applications.

BACKGROUND OF THE RELATED ART

A scent of a fragrance on a washed fabric is desirable for several reasons. One reason is that the scent of a fragrance reinforces the perception that the fabric has been laundered and, therefore, a stronger notion of cleanliness. There is also the reason that the scent of a fragrance is pleasing to some people.

Various methods are used to apply a fragrance to fabrics in the course of the industrial laundering process. One method is to introduce a fragrance aqueously in the wash cycle.

Another known method is to apply a fragrance to fabrics is seen in European Patent EP 0 676 497. In this method, a device is charged with compressed air and directly sprays perfume into the dryer via a spraying nozzle that is arranged within the region of the dryer lid.

Currently, another method used by some industrial launderers is to spray solutions of scented fabric softener on the garments just prior to delivery.

SUMMARY OF THE INVENTION

The present invention provides a fragrance dispenser apparatus and method for automated application of a fragrance to laundry fabrics and garments during an industrial laundering process. Typical types of garments laundered at such a facility include uniform shirts, uniform pants, executive (white) shirts, lab coats, aprons, jackets, and shop coats.

In the present invention, an apparatus for the automated application of a fragrance to cleaned fabrics is provided. In one embodiment, a fragrance dispenser is located outside the dryer, preferably positioned on the exit side of the steam tunnel in the laundering process. The steam tunnel is used for the dewrinkling of selected types of fabrics and garments. The fragrance dispenser includes a sensor for determining whether the passing garment is the type of garment to which the fragrance is to be applied, and a delivery system for applying the fragrance to selected garments. For example, there is a desire for uniform shirts to have a fresh scent after laundering. The fragrance dispenser may be configured to determine between shirts and say, pants, passing by on hangers on the conveyor belt. Also, the fragrance dispenser is positioned and configured to apply the fragrance to the garment after leaving the steam tunnel so the garment has begun its final cool-down in the laundering process. The delivery system of the fragrance dispenser includes a timing device for dispensing the fragrance onto the garment for a controlled and predetermined amount of time, so as not to overspray a garment and either stain the garment or leave too strong of a scent on the garment.

In an alternative embodiment of the fragrance dispenser, a bar code reader system may be used for the identification of garments belonging to specific customers. Accordingly, a selected fragrance of a selection of multiple fragrances may then be applied according to each customer's needs and desires.

In use, the method for applying fragrance to fabrics or garments using the fragrance dispenser is by providing a sensor to determine if the garment passing by on the conveyor, after exiting the steam tunnel, is of the type to which fragrance should be applied. For example, an optical sensor differentiates between shirts and pants by being positioned in such a way that only shirts pass within the range of the optical beam of the sensor, and are therefore sprayed with the fragrance. The fragrance dispenser will selectively spray garments by using a combination of the timing device and a relay to actuate the delivery system. The timing device will limit the cycle time to a controlled and predetermined amount of time, typically a fraction of a second, thereby regulating the amount of fragrance per spray, and preventing over-dispensing.

Also, the present invention will provide a fragrance that can either be sold as a ready-to-use, or a diluteable, concentrate.

In another embodiment of the present invention, an apparatus for the automated application of a fragrance to garments is provided in the dryer within the laundering process. The fragrance dispenser according to this embodiment typically includes a sensor for detecting the proper conditions for application of the fragrance to the garments in the dryer, a product media located in the air intake environment of the dryer, and a delivery system for applying the fragrance to the product media when triggered to do so. The system is configured to apply the fragrance to the product media during the cool-down phase of the dryer.

In use, the sensor senses when the temperature of the dryer has reached a predetermined setting during the cool-down phase of drying. Subsequently, the delivery system is triggered to apply the fragrance to the product media via an air-injection spray nozzle. The operation of the dryer draws air through the product media located in the air intake environment of the dryer, thereby applying fragrance to the garments while tumbling in the dryer.

While embodiments of the present invention can be used in an automated fragrance dispenser to apply fragrance to fabrics and garments, it should be noted that the present invention may be adapted for use on other systems, such as to position the fragrance dispenser in an assembly line process that requires a final coating or application of an aqueous-based chemical. For example, one could use such a system and method to apply fragrance to sheets or towels on a folding machine.

In sum, the present invention represents a significant improvement over the prior art fragrance-dispensing method and apparatus systems in many ways. The fragrance dispenser apparatus and method in accordance with the present invention allows for a fragrance to be applied to garments with a lingering scent, for such application to be automated, for the application to be on selective garments, for dispensing a controlled amount of fragrance to the selected garment, and overcomes the disadvantages of the prior art. These and various other features as well as advantages, which characterize the present invention, will be apparent from a reading of the following detailed description and a review of the associated drawings.

DETAILED DESCRIPTION OF AN EMBODIMENT

The invention provides a fragrance dispenser apparatus and method for automated application of fragrance to cleaned fabrics in an industrial laundry facility. The application of the fragrance preferably takes place either outside the dryer and preferably subsequent to the passing of the fabric, or laundered garment, through a steam tunnel during the process of laundering, or in the dryer during the cool-down drying phase of the laundering process.

A fragrance may be considered any component that imparts a desirable scent to a fabric after it has been cleaned. The present invention will provide a fragrance that can either be sold as a ready-to-use, or a dilutable, concentrate. As discussed earlier, a concern is that a fragrance applied on fabrics tends to evaporate after heat-treatment of the fabric occurs.

Therefore, it is desirable to apply fragrance to a fabric after maximum heat-treatment of the fabric has already occurred. By letting the fabric cool and dry somewhat before applying the fragrance, significant evaporation of the fragrance is avoided, allowing the fabric to retain as much fragrance and lingering scent as possible. While the fabric does not have to be completely dry, it is desirable that the fabric be dryer than it is at its most wet stage, with that most wet stage most likely to occur in the washing phase.

Typically, heat-treatment within the conventional laundering process can be either in the form of drying or in the form of dewrinkling. Drying is done in a drying machine and dewrinkling is typically done in a steam tunnel. Fabrics being processed through a steam tunnel are typically subjected to steam for a period of time ranging from about 30 seconds to 1 minute at temperatures between about 270° and 290° Fahrenheit.

In conventional laundry facilities, several different types of fabrics are laundered. While it is typical that all types of fabrics require drying, not all types of fabrics require dewrinkling in a steam tunnel. Examples of fabrics that do not necessarily require dewrinkling in a steam tunnel include towels, sheets, and pillowcases. Examples of fabrics that typically do require dewrinkling are uniform shirts and pants, executive shirts, and lab coats.

Figure 1:
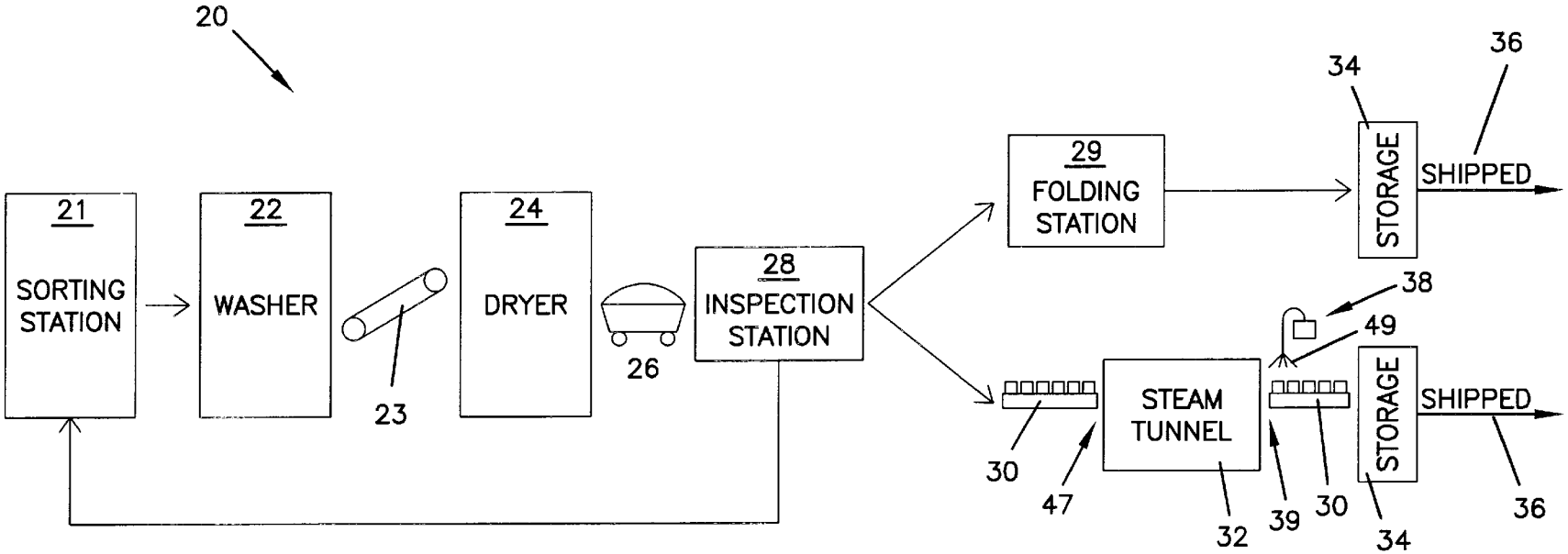
FIG. 1 illustrates the placement of the automated application of fragrance in a laundering process, according to a possible embodiment of the present invention.

Referring now to FIG. 1, which illustrates a typical industrial laundering process, shown generally as 20. First, the dirty garments are sorted at a sorting station 21. Typical sorting categories include towels, sheets, uniforms, and shirts. The garment to be laundered is then washed in a washer 22. As stated above, in the past the washer 22 has been a typical point of fragrance application, the fragrance basically being added as a washing agent. Industrial washers made by Ellis and by Braun are examples of typical washers founds in such a process. The garment is then sent, such as on a conveyor 23 or the like, to the dryer 24. As discussed above, a disadvantage of fragrance being applied prior to heating in the dryer 24 is that volatile fragrances are drawn off and degraded by the heat of the dryer, leaving a diminished scent of the fragrance on the garment. After the drying process, the garment is put on a cart 26 or the like, and sent to an inspection station 28.

At the inspection station 28, fabrics that have not been washed and/or dried to satisfaction are returned to the sorting station to be washed and/or dried again. Typically, fabrics that do not require dewrinkling go to the folding station 29, and then are stored 34 for an average of 1–3 days before being shipped 36 to the customer via truck, or the like. For these fabrics it is desirable to apply the fragrance at a point during the cool-down phase of the drying operation 24.

The fabrics that do require dewninkling are hung on a conveyor 30, or the like, for further processing. These fabrics are typically sent through the steam tunnel 32 to be dewrinkled. For these fabrics it is desirable to apply the fragrance at a point after the fabric exits the steam tunnel 32. Here, again, more fragrance that may have been applied in the washing phase under a previous method of fragrance-application would be lost in the steam tunnel 32 due to the heat.

Also, often it is not desirable to apply fragrance to all fabrics, or garments, that pass through the steam tunnel 32. Rather, it is often desirable to selectively apply fragrance to certain types of these fabrics that pass through the steam tunnel.

For example, after the inspection station 28, sheets and towels are folded 29 and sent to storage 34 and subsequently shipped 36. While shirts and pants, requiring dewrinkling on the other hand, are hung on the conveyor 30 and sent through steam tunnel 32 to get the wrinkles out. It may be desirable that not both shirts and pants have fragrance applied, but only that shirts have fragrance applied.

After exiting the steam tunnel 32, the garments, or laundered material, are also stored 34 for an average of 1–3 days before being shipped 36 to the customer via truck, or the like.

Application of Fragrance to Garments Which Require Dewrinkling

In one embodiment of the present invention, a fragrance dispenser, shown generally as 38, is positioned outside the dryer, and preferably on the exit side 39 of the steam tunnel 32, to apply fragrance to selective garments that do require dewrinkling. Accordingly, these garments are passed through the steam tunnel. As a garment exits the steam tunnel 32 hanging on a hanger 40 (FIG. 2) on the conveyor 30, the garment is processed through fragrance dispenser 38.

As discussed above, it is not always desired that all of the garments passing through the steam tunnel 32 receive a spray of fragrance.

Figure 2:
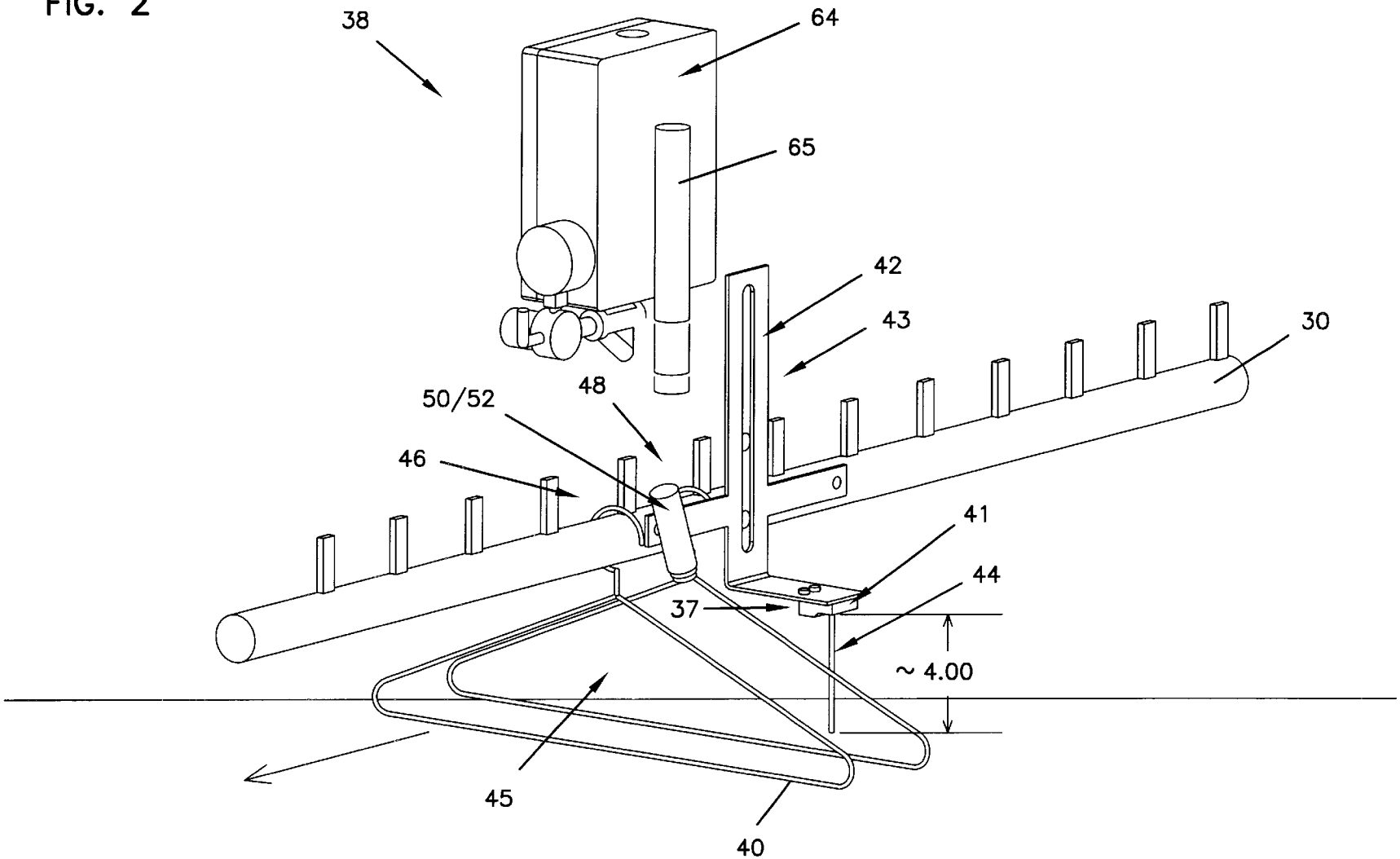
FIG. 2 illustrates a partial perspective view of the fragrance dispenser in a possible embodiment of the present invention.
Figure 3:
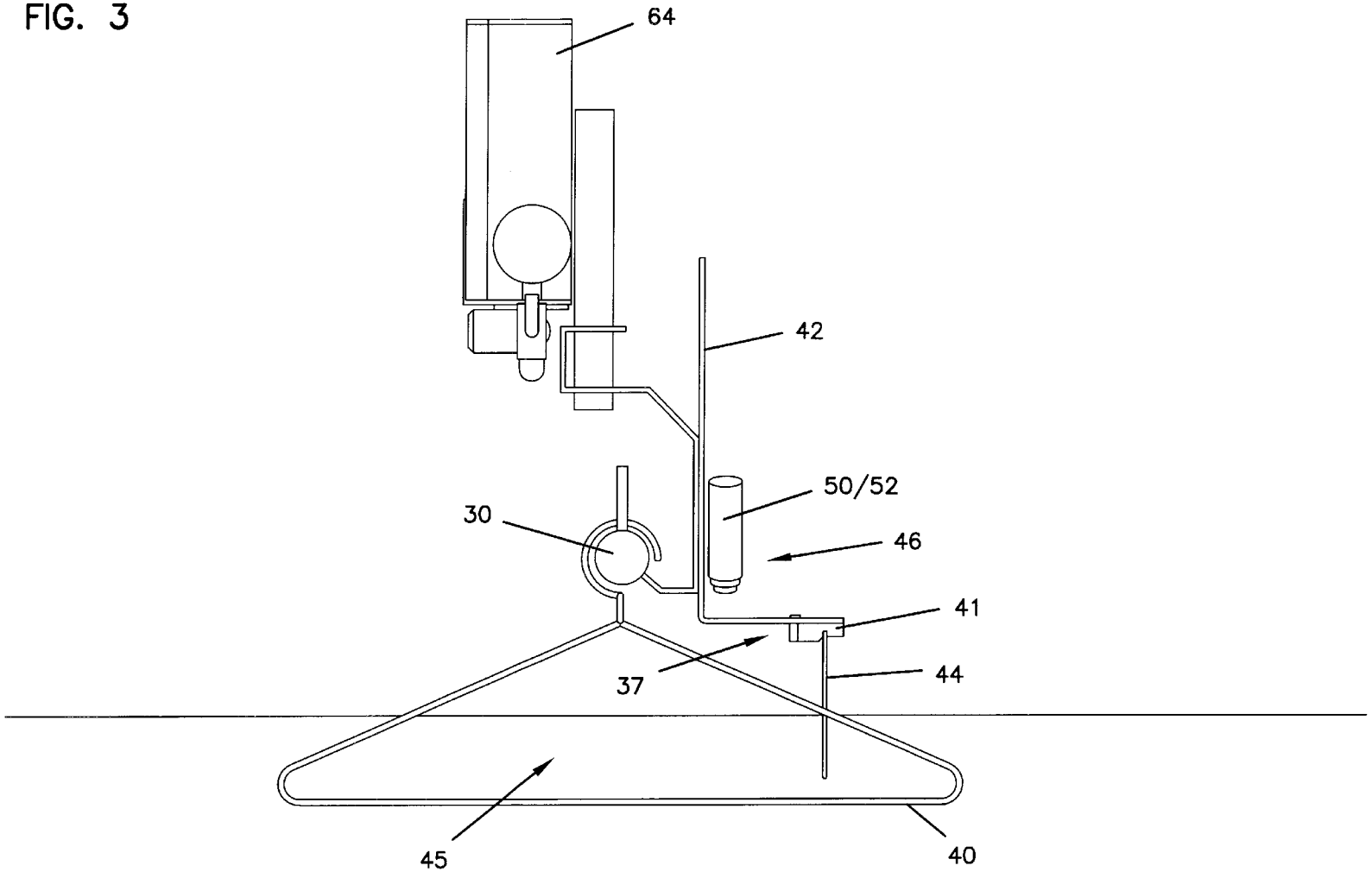
FIG. 3 illustrates a partial end elevational view of the fragrance dispenser shown in FIG. 2.

As seen in FIGS. 2 and 3, the fragrance dispenser 38 includes a sensor 37, here shown as an optical sensor 41, which the garment on the conveyor 30 passes. In one embodiment, the optical sensor 41 is positioned such that it differentiates between pants and shirts that are passing by on the conveyor 30.

The optical sensor 41 may be mounted on a mounting assembly 43, such as adjustable bracket 42 shown here, which is typically mounted on the conveyor 30. The adjustable bracket 42 is able to be adjusted such that the optical sensor 41 is in position to differentiate between garment types as required.

The optical sensor 41 has an IR beam 44. The beam 44 is adjusted so that it is pointed through the yoke 45 of a passing hanger 40. If the beam 44 of the optical sensor 41 is broken by an object, i.e., a garment, positioned within the yoke 45, a delivery system, shown generally as 46, will be triggered to spray 49 the fragrance on the garment.

In the other instance, if the beam 44 is not broken by a garment in the yoke 45 of the hanger 40, the delivery system 46 will not be triggered to spray the garment. The positioning of pants and shirts on a hanger 40 are such that shirts are positioned higher on the hanger 40 covering the yoke 45, and only they pass within the range of the optical beam 44. The beam 44 may be such that a hanger, say of ⅛" thickness, will not break the beam 44 to trigger the delivery system 46. The sensor 41 may be a typical optical sensor, generally running off of 24 VDC.

The volatility of the fragrance generally does not allow placement of the fragrance dispenser 38 before the entry side 47 of the steam tunnel 32 due to the heat applied by the steam tunnel, which may be between 270° and 290° Fahrenheit. Placement of the fragrance dispenser 38 on the exit side 39 of the steam tunnel 32 will allow fragrance to be applied when the fabric has at least begun to cool down. The fabric still being somewhat warm helps because the fragrance is typically a combination of water with approximately 5% fragrance, so the water evaporates off the heated fabric, leaving the fragrance to have a lingering scent. While the fragrance dispenser 38 may generally be placed anywhere after the exit side 39 of the steam tunnel, it is preferred that it be placed at a minimum of 5 feet after the exit side 39 of the steam tunnel, based on a general conveyor speed of approximately 1" per second.

The delivery system 46 includes a spraying apparatus 48, preferably a spray nozzle 50 as shown here, with a check valve 52. The spray nozzle 50 and check valve 52 may be mounted on the adjustable bracket 42. An example of a suitable spray nozzle is Spraying Systems® 4005 V-jet spray nozzle, which typically sprays at the rate of 0.25 to 0.50 GPM. Generally, a consideration in the selection of the nozzle may be that its capacity allow normal operation of the aspirator while creating a mist that will be absorbed by the garments. Nozzles with higher capacities typically create droplets that roll off the garments. Nozzles with lower capacities typically restrict the flow of water, inhibiting the aspirator's function.

An example of a suitable check valve is a ¼" PVC spring-loaded check valve with approximately 1 psi cracking pressure, generally chosen for its size and pressure rating.

Figure 4:
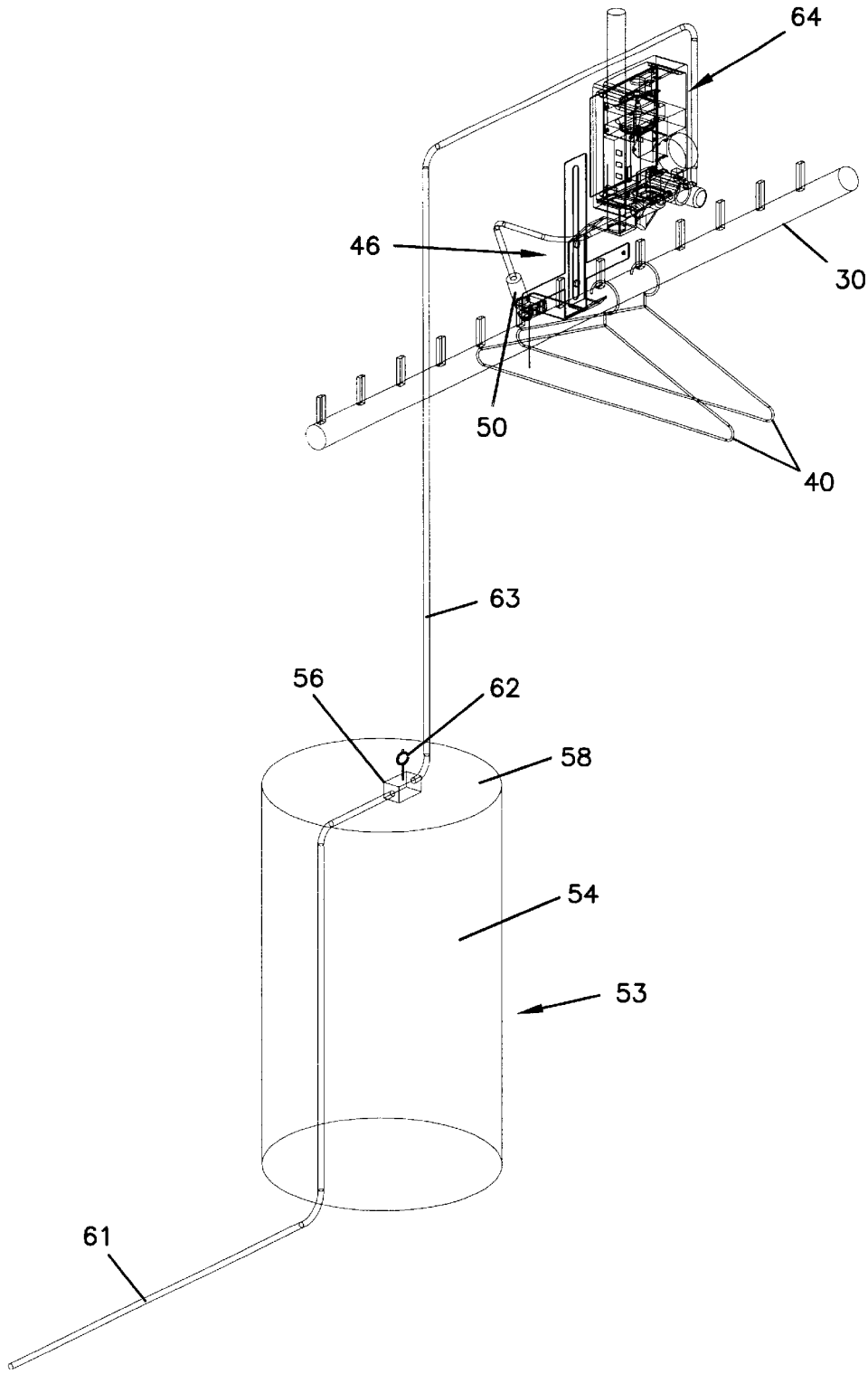
FIG. 4 illustrates a side elevational view of the fragrance dispenser in a possible embodiment of the present invention.

As seen in FIG. 4, a fragrance reservoir 53, preferably a barrel 54 or the like, containing the fragrance may be placed on the ground near the delivery system 46. The placement of the barrel 54 is flexible so as to be placed anywhere desired. Any suitable size of barrel may be used. A suitable size for the barrel 54 is thirty gallons. Typically, approximately ½ gram of fragrance is sprayed per shirt, as will be discussed below. In this case, in a typical laundering facility, 5 gallons of fragrance would generally last approximately 2 weeks.

An aspirator 56 may be mounted to the top side 58 of the barrel 54 containing the fragrance. An example of a suitable aspirator is a Dema 200-3C brass injector aspirator, with an injection rating at 0.1 to 0.3 GPM. A water-based aspirator is preferred, as it will help to keep the fragrance on the garment, and reduce the amount of mist and vapor floating into the environment of the laundering facility. This also helps to avoid airborne particles that could be hurtful to people's eyes or skin. In an alternative embodiment, an air aspirator may be used.

A metering needle 62 is mounted on the aspirator 56. The aspirator 56 has a metering needle 62 for adjusting fragrance injection, as well as its three injector jet inserts which can vary the injection rate further.

As the water supply 61 passes through the aspirator 56, a low pressure chamber creates a vacuum which draws fragrance up and into the stream, based on the venturi effect.

The fragrance barrel 54 is in fluid communication with the delivery system 46. A supply line 63 connects the barrel 54 to the spray nozzle 50.

An electrical enclosure box 64 is mounted near the spray 49 location of the fragrance dispenser 38, typically being mounted to a pole 65 on the exit side 39 of the steam tunnel 32.

Figure 5:
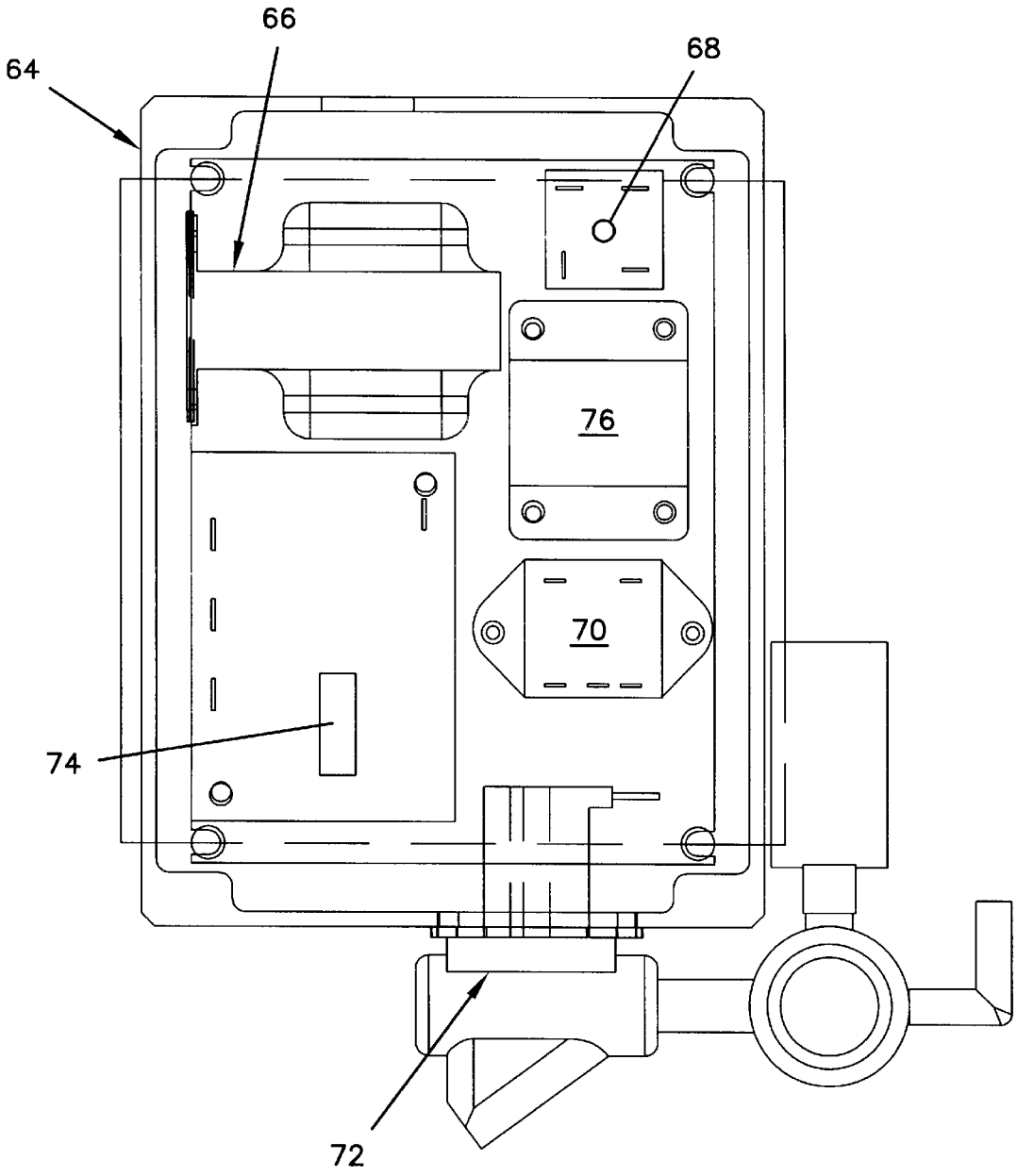
FIG. 5 illustrates an enlarged view of components of the electrical enclosure box, as shown in FIG. 2.

As seen in FIG. 5, the electrical enclosure box 64 typically includes a transformer 66 which coverts the input 115 VAC to supply 24 VAC. Rectifier 68 rectifies the 24 VAC into 24 VDC. The rectifier powers both the sensor 37 and a relay 70.

Typically the electrical enclosure box 64 also includes relay 70. The delivery system 46 may be cycled by the activation of the relay 70, which actuates solenoid valve 72. An example of a suitable relay that may be used is a Banner Econobeam photoelectric switch. The solenoid valve 72 is a standard solenoid valve, typically also 24 volt. An example of a suitable solenoid valve that may be used is a Dema 442P 24 VAC solenoid valve.

The electrical enclosure box 64 of the fragrance dispenser 38 may also include a timing device 74. The timing device 74 limits the amount of fragrance sprayed onto a garment by limiting the actuation of the solenoid valve 72 to a short period of time. The timing device 74 is a means of limiting the cycle time of the delivery system 46 to a fraction of a second, thereby regulating the amount of fragrance and preventing over-dispensing.

A preferred length of spray of fragrance onto the garment is generally between 0.1 and 0.5 seconds. With the given dispense rate of a preferred aspirator, the amount of "on" time of the delivery system is sufficient to dispense the desired amount of fragrance to the garment. Additionally, for spray times longer than 0.5 seconds, the garments are generally soaked with too much liquid.

In an alternative embodiment, a snap switch apparatus (not shown) may be used in place of a timing device 74. The snap switch is a generally 1"×½" rectangular component with a short lever that closes a switch when depressed. The switch is mounted in such a way that a peg or tab on the conveyor depresses the lever as it goes by, thereby activating the fragrance dispenser's circuit.

The electrical enclosure box 64 may also include a counter 76 to track the number of garments sprayed. The counter 76 is typically activated when the solenoid valve 72 is activated. Therefore, the counter will not count every garment that passes by the sensor 37, but rather will count every spray of the fragrance by the delivery system 46.

Because the solenoid valve 72 may still be activated despite the event that the fragrance dispenser 38 has run out of fragrance, an alarm (not shown) may be installed to alert the user of such instance. For example, a vacuum sensor may be installed in the barrel 54 that would sense when the fragrance in the barrel 54 was at, or near, empty. An alarm or light would then give notification. Another example is to put a float on a probe (not shown) in the barrel 54 so that when the level of fragrance drops down, the float closes a switch, sensing that the fragrance is at, or near, empty. Also, rather than an alarm or light giving notification that the level of fragrance is at, or near, empty, the fragrance dispenser 38 may be set up to shut down at that time.

In an alternative embodiment, a bar code reader (not shown) may be used to automatically differentiate between garments belonging to certain customers or routes, i.e., a group of customers on the same delivery route. A customer or route may be assigned a code, which is identified as the garment passes by an electronic reader (not shown). Based upon the identification of a certain customer or route, the information in the code will activate one of several solenoid valves, which will dispense the specific fragrance desired by the customer or route.

Further, in another possible embodiment, this differentiation between garments belonging to certain customers or routes may be done manually. Because customers and routes are typically grouped and processed together, the garments may be identified with a means such as color-coding or a divider to notify the operator of a desired fragrance change. The operator may then select the customer's or route's desired fragrance by means of a multi-position switch (not shown) which diverts the input signal to cycle the appropriate solenoid valve to dispense the desired fragrance.

In the operation of one possible embodiment of the fragrance dispenser 38 positioned on the exit side 39 of the steam tunnel 32, a garment on a hanger 40 hanging on the conveyor 30 passes by the sensor 37, here an optical sensor 41, of the fragrance dispenser 38. If the beam 44 of the optical sensor 41 is broken by the garment, the delivery system 46 is triggered. The delivery system 46 will then spray 49 a controlled amount of fragrance onto the garment.

The operation of the fragrance dispenser 38 typically requires 115 VAC. Generally, the 115 VAC enters into the 24 volt DC or AC transformer 66, changing the voltage of the alternating current from 115 VAC to 24 VAC. The 24 volts may then be rectified by rectifier 68 into 24 VDC to power both the optical sensor 41 and relay 70.

The fragrance is injected by aspirator 56 from the barrel 54 into the supply line 63 leading to the nozzle 50. The pressure of the fragrance leaving the barrel 54 may be regulated by the metering needle 62 attached to the aspirator 56.

When it is determined that a garment passing by the optical sensor 40 is of a type such that a spray 49 of the fragrance is desired, the relay 70 actuates the solenoid valve 72, which activates the nozzle 50 to dispense the controlled amount of fragrance onto the garment. The timing device 74 limits the actuation time of the solenoid valve 72 to a specified period of time, thereby limiting the amount of fragrance sprayed onto the garment.

The counter 76 tracks the number of garments sprayed by being activated when the solenoid valve 72 is activated.

Application of Fragrance to Garments Which Do Not Require Dewrinkling

Figure 6:
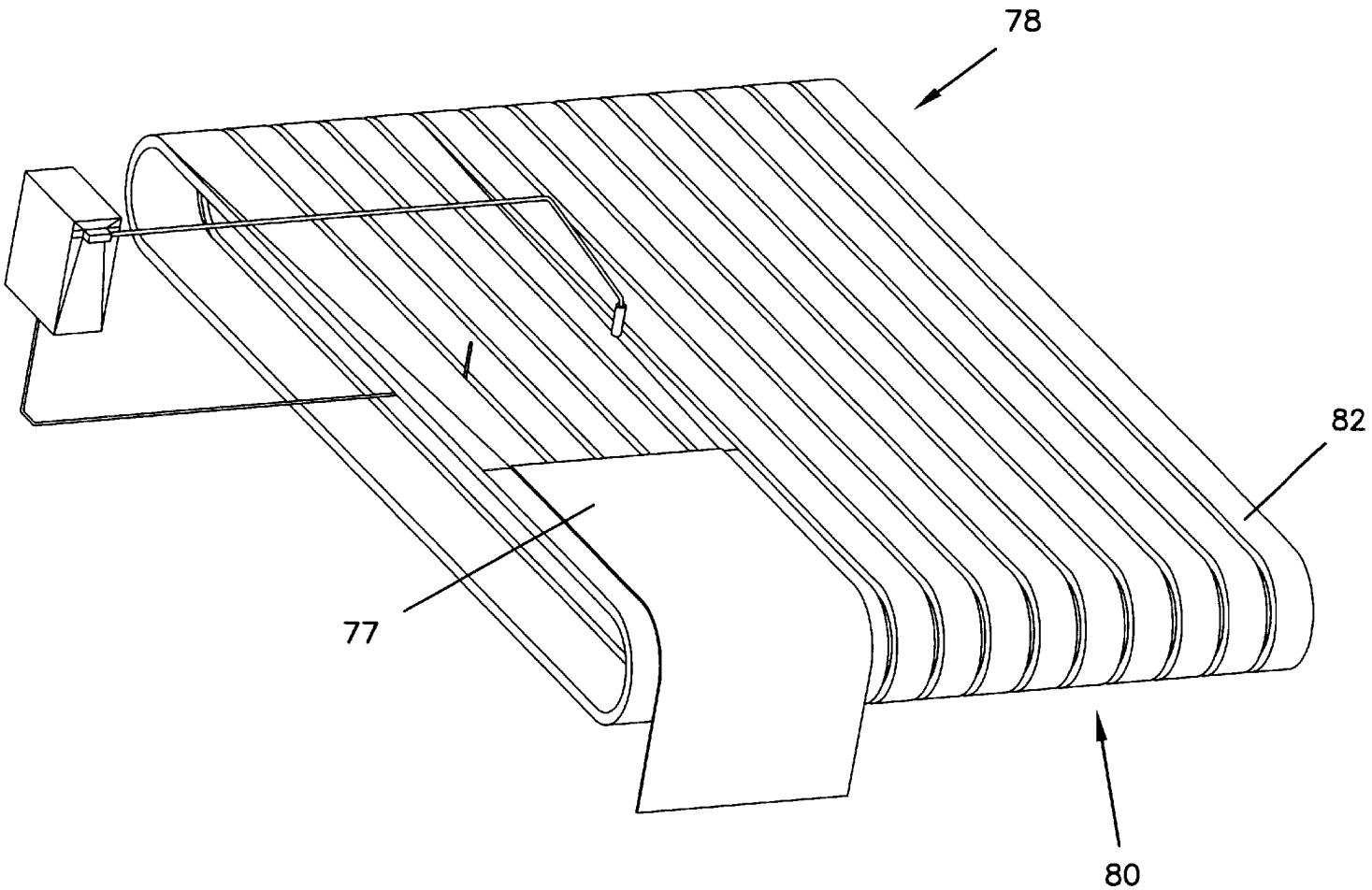
FIG. 6 illustrates a partial view of a typical folding machine found in a laundering process, including a partial view of a possible embodiment of the fragrance dispenser of the present invention.

As discussed above, not all garments require dewrinkling. These garments, after leaving the dryer 24 and being carted 26 to the inspection station 28, are sent to the folding station 29 and are subsequently stored 34 and shipped 36. For these garments, in an alternative embodiment of the present invention, rather than placing the fragrance dispenser 38 at the exit side 39 of the steam tunnel 32, the fragrance dispenser 38 may be positioned at the folding station 29. A folding machine, shown generally as 78 in FIG. 6, is a typical machine found at a folding station 29 in an industrial laundering facility. At a typical folding machine 78, the garment or linen 77, usually a towel, pillowcase, sheet, or the like, is placed flat on the folding machine and then mechanically folded. The fragrance dispenser 38 may be used to differentiate between, for example, sheets and pillowcases for which a spray of fragrance may be desired, and towels for which a spray of fragrance may not be desired. The fragrance dispenser will then spray the desired garment with fragrance.

Figure 7:
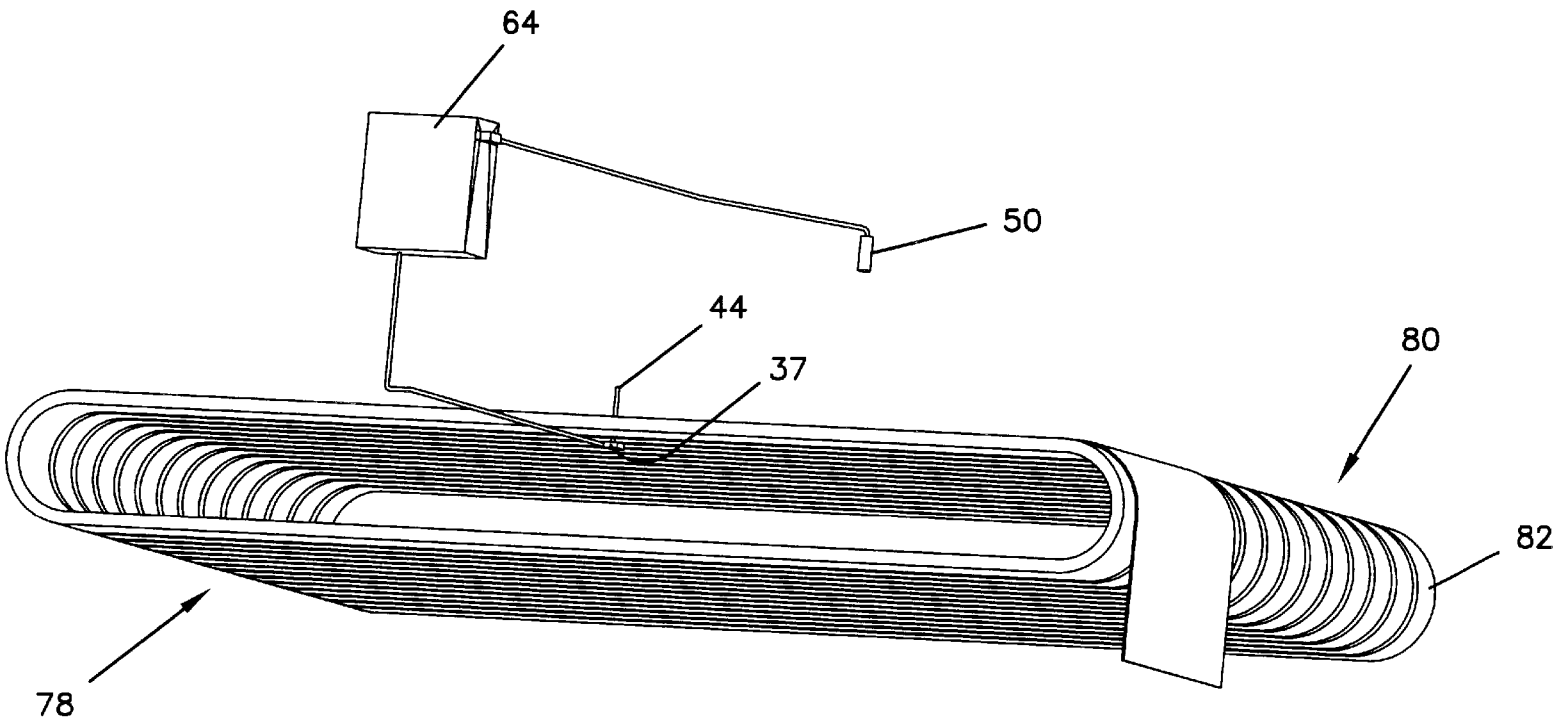
FIG. 7 illustrates a partial view of the folding machine and fragrance dispenser shown in FIG. 6.

As seen in FIG. 7, a typical folding machine has a conveyor belt 80 made up of approximately a dozen 5" wide rubber strips 82, typically with a 1"–2" gap between each strip 82. The linen 77 is laid flat on the conveyor belt 80 which conveys it into the interior of the folding machine 78, where the linen is folded.

In one possible embodiment, the sensor 37 may be positioned beneath the conveyor belt 80 in order to sense the sheets and pillowcases as they pass above it. The spray nozzle 50 may be situated above the linen 77 to spray the linen as it passes over the sensor 37, and before the linen is folded. When the sensor 37 senses a linen 77 within the sight of its IR beam, the delivery system 46 is triggered to spray.

Linens 77 may be aligned to pass within the sight of the IR beam 44 either because their size is such that they occupy that amount of space on the conveyor belt 80, or because the particular piece of linen 77 is positioned on the conveyor belt 80 to pass within the sight of the IR beam 44, or by other suitable means.

In an alternative embodiment, as discussed above, a bar code reader (not shown) may be used at the folding station 29 to identify a particular customer's or route's garments, and a selected fragrance, among multiple fragrances, may be sprayed accordingly.

In another possible embodiment of the present invention, in the application of a fragrance to fabrics that do not require dewrinkling, a fragrance may be applied to the fabrics while in the dryer 24. This embodiment is advantageous because the tumbling of the garments within the dryer, after application of a fragrance, helps to evenly distribute the fragrance to all the garments within the dryer 24.

This method may also be used for fabrics that do require dewrinkling in the steam tunnel 32. However, because of the heat applied in the steam tunnel, the lingering scent of the fragrance would be diminished, as discussed previously. It is desirable that the application of the fragrance to the garments in the dryer 24 is done during the cool-down phase of the dryer 24, thereby minimizing the loss of fragrance from the fabrics.

During the drying process, water is removed from the fabric. Because the vapor pressure of a fragrance is typically less than that of water, the fragrance would be expected to evaporate with the water. Accordingly, applying the fragrance to the garments at a point where the temperature of the dryer 24 is below the vaporization point of the fragrance is preferable.

Figure 8:
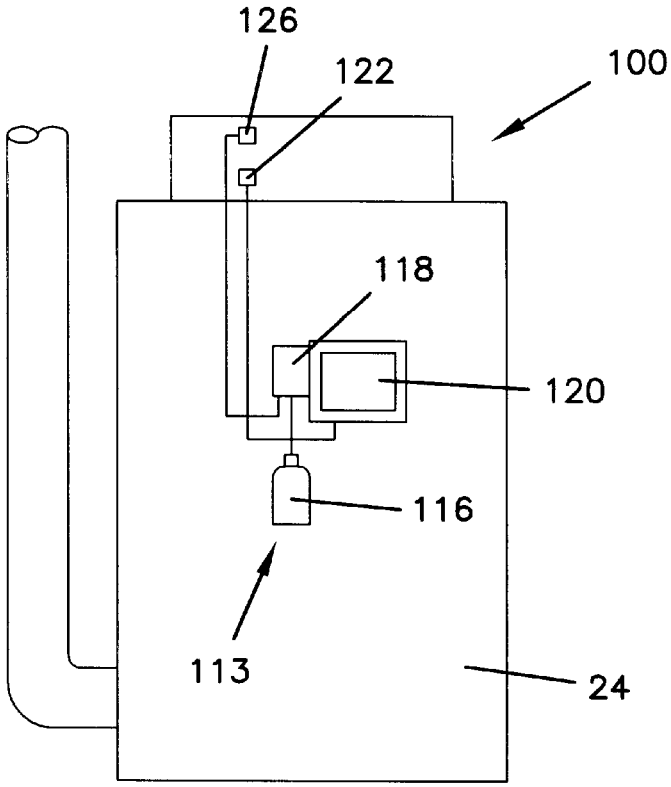
FIG. 8 illustrates a partial side view of a dryer in a typical laundering process, with a possible embodiment of the fragrance dispenser shown in schematic.

Accordingly, in this alternative embodiment, the present invention provides a fragrance dispenser, shown generally here as 100 in FIG. 8, for applying a fragrance to fabrics while the fabrics, or garments, are in the dryer 24 phase of the laundering process (see FIG. 1). This embodiment of the present invention can be used in most any conventional industrial dryer 24.

Figure 9:
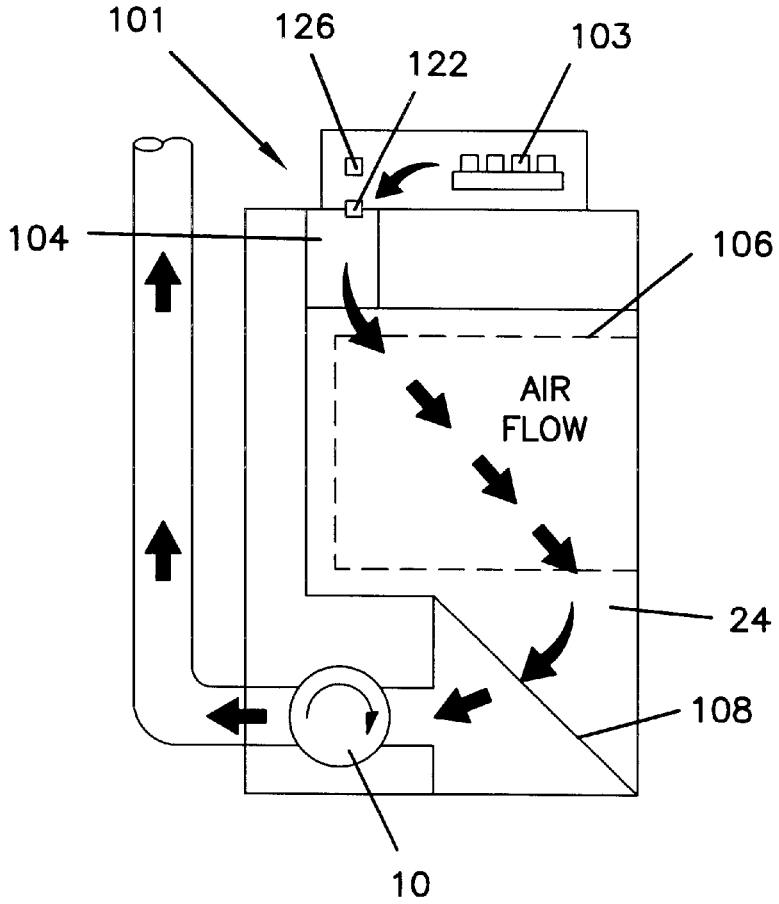
FIG. 9 illustrates a partial cross-sectional view of the automated application of fragrance in a dryer during the laundering process, according to principles of the present invention.

As shown in FIG. 9, a conventional dryer 24 generally has a burner 103 which draws air through the air intake environment 101 of the dryer 24, and typically through an air vent 104, or set of air vents, of the air intake environment 101 leading to the rotating drum 106. The burner is typically a gas, electric, or steam burner. The burner blows the heat into the body of the dryer 24. The air, typically heated, flows through air vent 104 the air intake environment 101 to the dryer rotating drum 106, through the rotating drum 106, a lint filter 108, and out through an exhaust fan 110.

Figure 10:
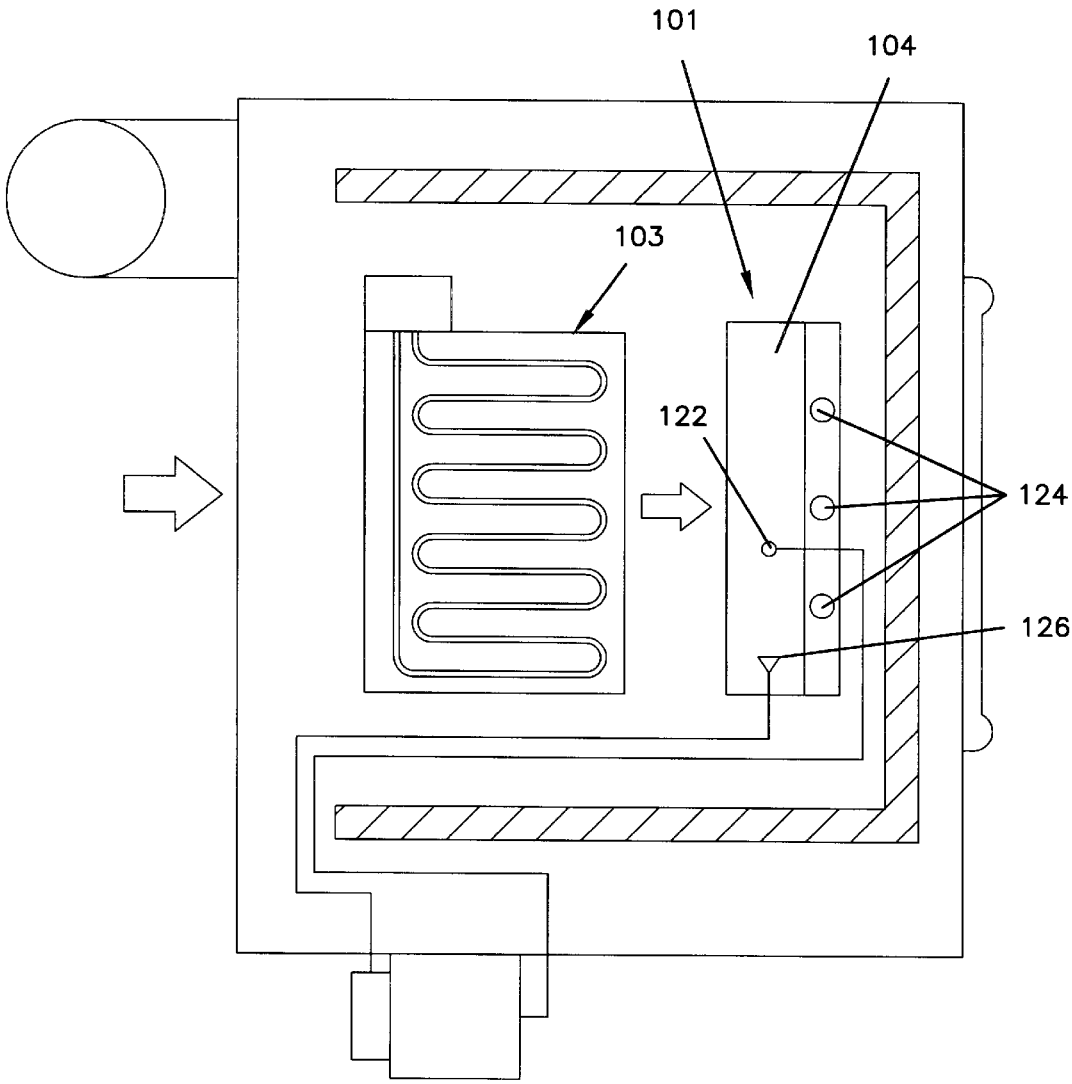
FIG. 10 illustrates a partial top view of the interior of a dryer in a typical laundering process, according to principles of the present invention.

Referring now to FIG. 10, typically three sets of thermostats 124 are positioned in the air intake environment 101, near the air vent 104 to the rotating drum 106. The thermostat settings control the air temperature entering the dryer 24. The temperature settings of the thermostats 124 are set depending on the type of fabric being dried. In some industrial dryers, the thermostats are positioned beneath the rotating drum 106.

Figure 11:
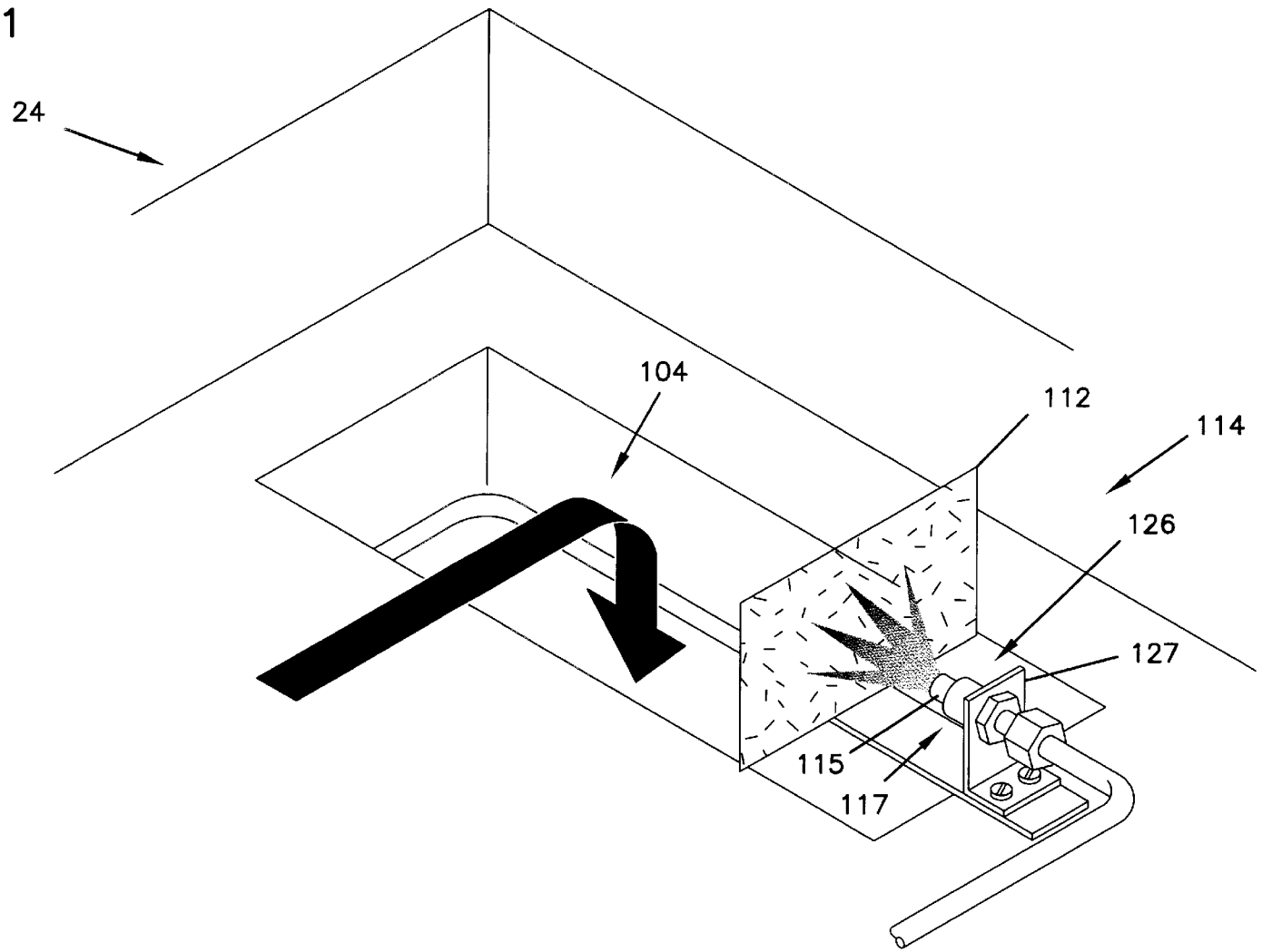
FIG. 11 illustrates a partial perspective view of the top of the interior of a dryer in a typical laundering process, according to principles of the present invention.
Figure 12:
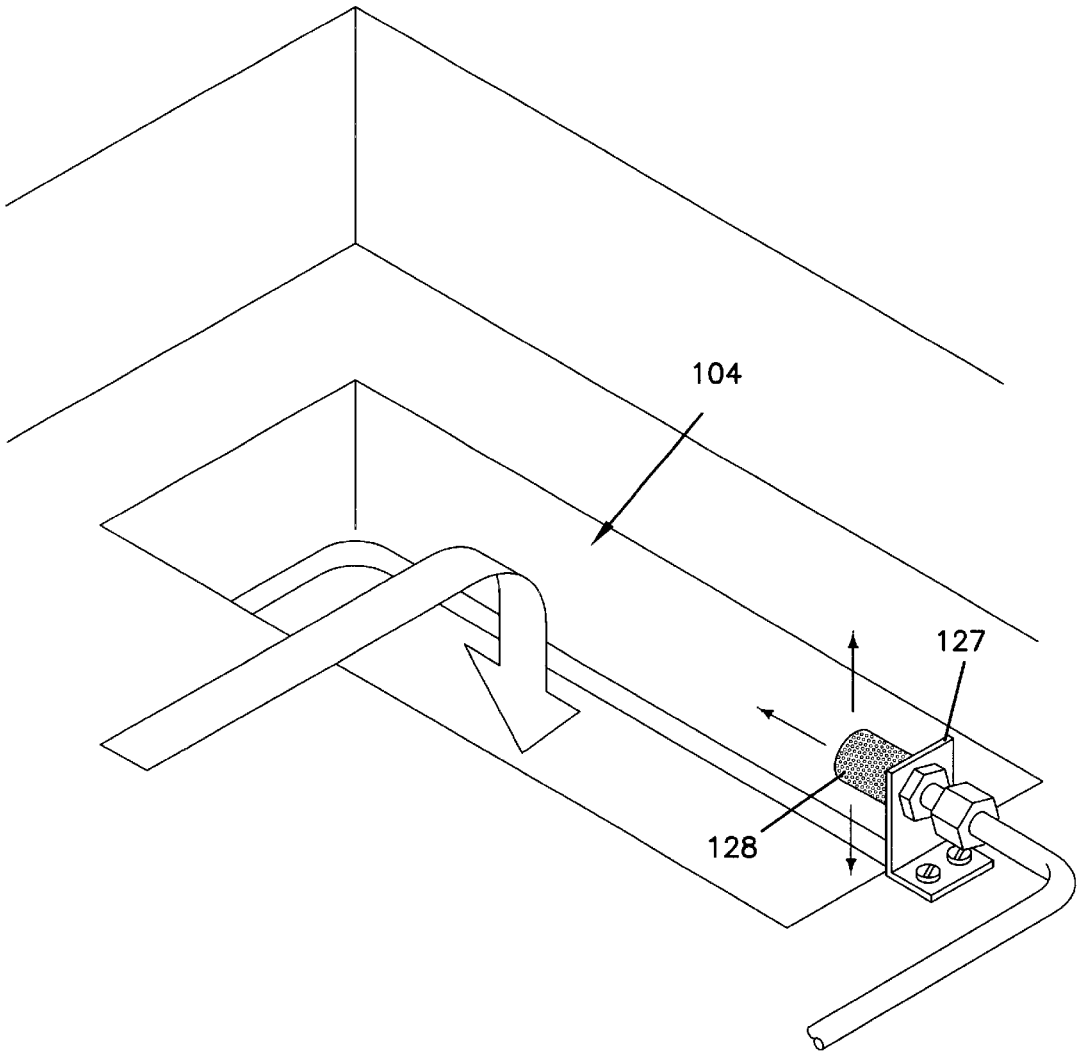
FIGS. 12–15 illustrate various possible embodiments of the delivery system for the fragrance dispenser shown in FIG. 11.
Figure 12A:
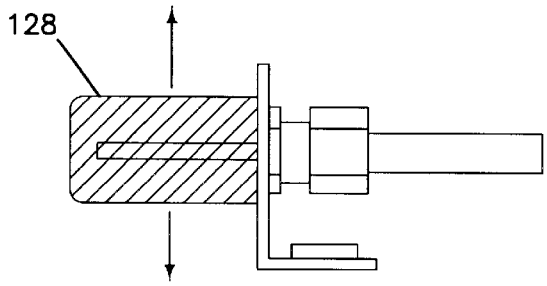
Figure 13:
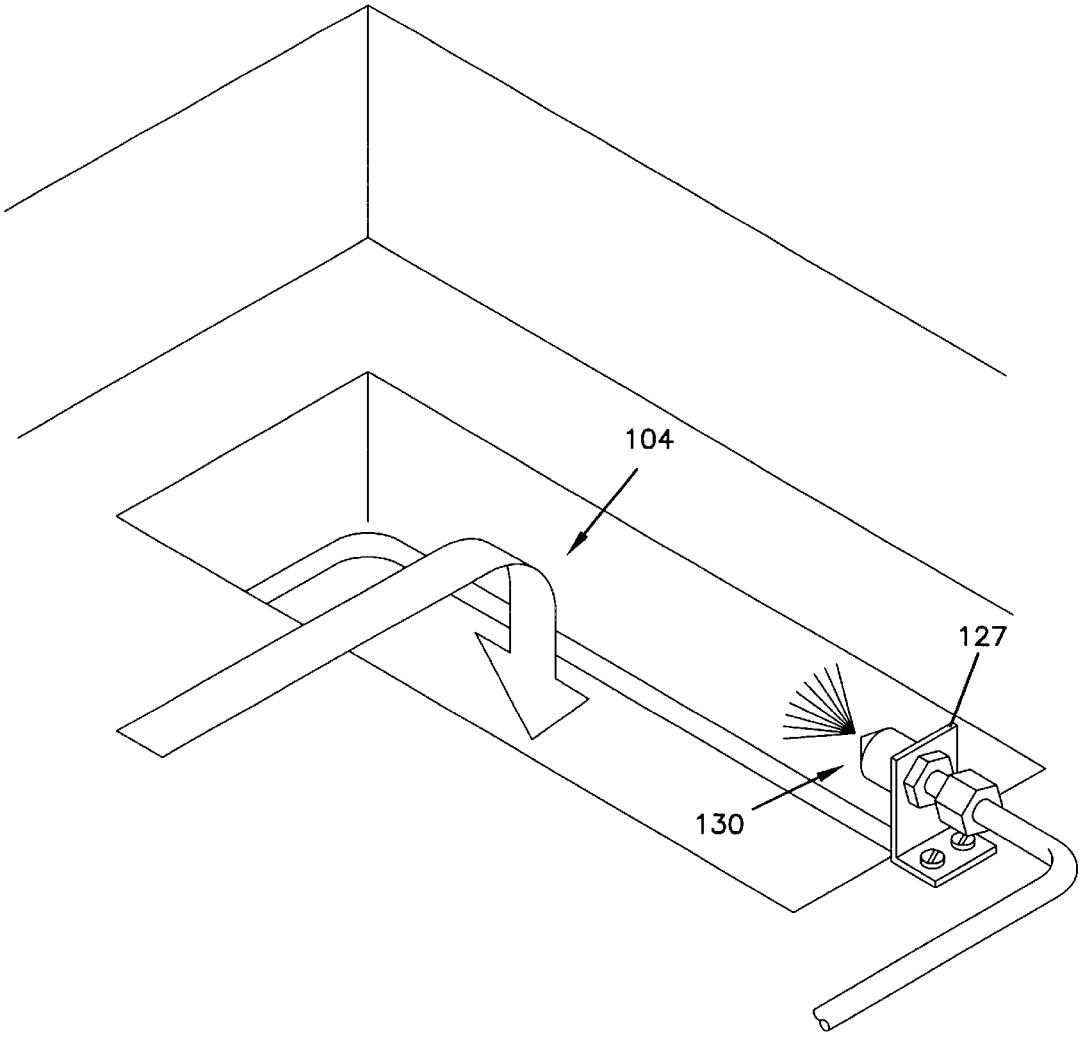
Figure 13A:
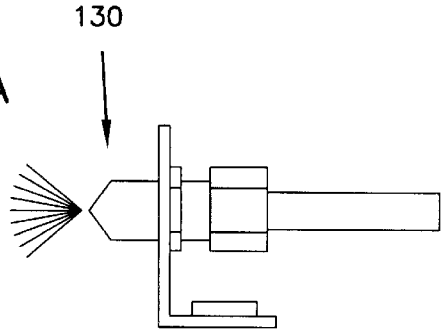
Figure 14:
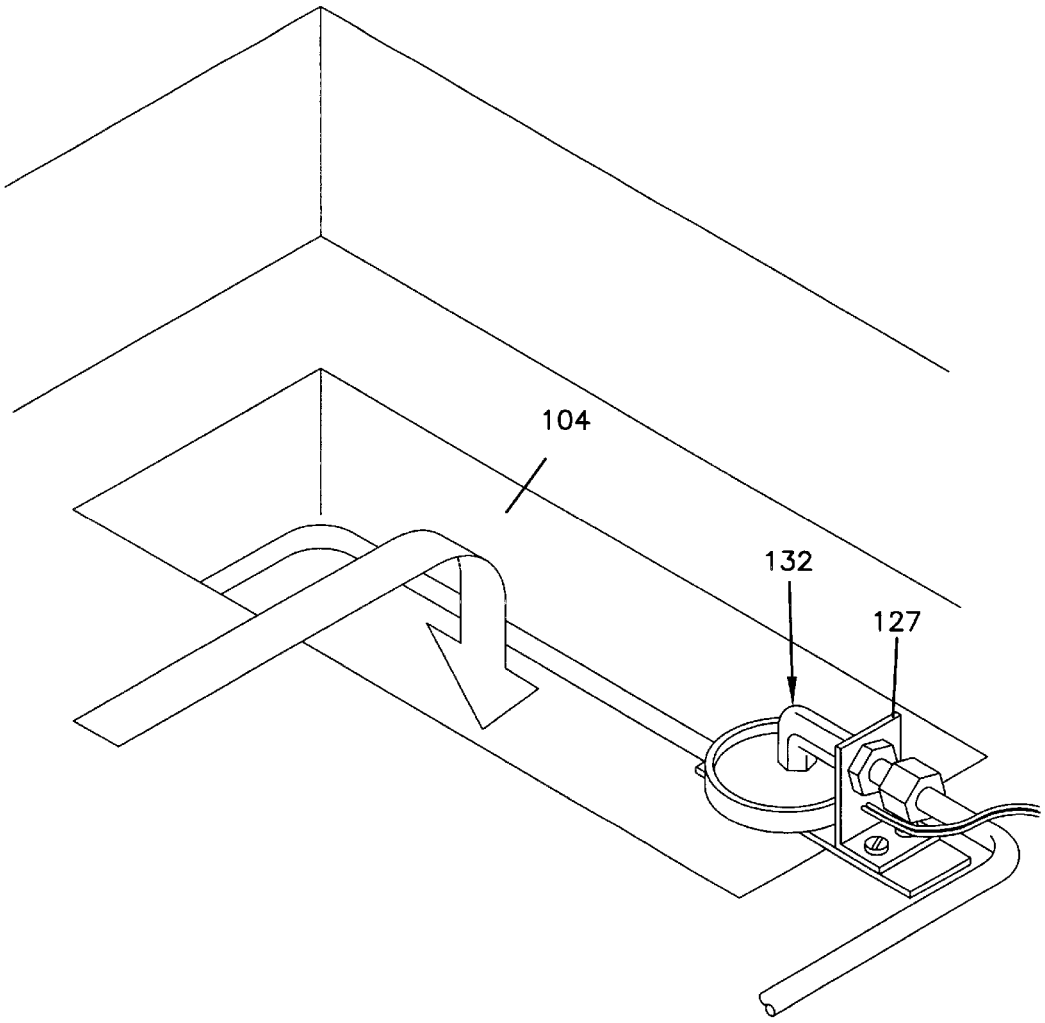
Figure 14A:
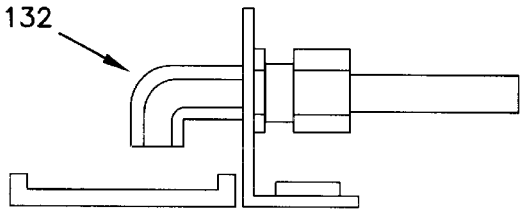

Referring now to FIG. 11, in the present invention a product media 112 is positioned in the air intake environment 101 of the dryer 24. A delivery system 114 is configured to apply the fragrance to the product media 112 during the cool-down phase of the dryer 24.

As seen in FIG. 8, a fragrance reservoir 113, shown here as product container 116, is in fluid communication with the delivery system 114. The product container holds the concentrated product of the fragrance. The product container 116 is typically positioned on the outside of the dryer 24, along its side.

Typically, a pump 118 is positioned on the side of the dryer 24, adjacent the product container 116, and in fluid communication with the product container 116.

The apparatus also includes a diluting system, which is in fluid communication with the delivery system 114 and the fragrance reservoir 113. While the fragrance reservoir 113 has a concentrated product, the diluting system dilutes the concentrate with a diluent. The diluent may be any suitable substance, such as water.

As discussed above, a goal of the fragrance application is for the scent to linger for a sufficient amount of time. For example, with towels the time between drying and use is usually approximately 1 to 2 days. Concentrations can vary depending on how it is diluted. One embodiment of a typical approximate concentrate make-up is 87% water, 3% lemon fragrance, 6% nonylphenol ethoxylate 9.5 mole, 3% nonylphenal 15 mole ethoxylate, and 0.80% alkyl pimethyl benzl ammonium chloride. The Alkyl is a quatinary product, which has a tendency to adhere to linen because of its positive charge. This may contribute to having carryover of the fragrance on the product media from one cycle to the next, which may save product, save money, and leave a stronger scent.

Other concentrates may be preferred because of their special characteristic fragrances, which contain odor-counteractants. An example of this would be an approximate concentrate make-up of 70–99.5% water (zeolite softened), 0–5% nonylphenol ethoxylate, and 0.5–30% fragrance or odor counteractant. Generally, any suitable concentrates may be used. However, it appears that lemon-scent concentrates may be preferred among consumers.

The diluting system includes a venturi (not shown). The diluent is drawn through the venturi, which is in fluid communication with the source of conceritrate in the product container 116.

A PC Board 120 is also typically positioned on the outside of the dryer 24, along its side. Control logic is used to control the arming and activation of the delivery system 114, as discussed in greater detail below.

A fragrance control temperature sensor 122 is positioned in the air flow of the dryer 24 (FIG. 8 and FIG. 10). Preferably, the temperature sensor 122 is positioned downstream of the burner 103, because it is sensing when the burner is not on, yet located proximate the thermostats 124. If desired, the temperature sensor 122 may also be positioned otherwise, such as below the rotating drum 106 of the dryer 24. The sensor 122 is typically a temperature based thermal sensor. The temperature sensor will detect the temperature at the point of injection of the fragrance to the product media 112. Sufficient lead lengths are supplied to allow proper placement of the temperature sensor 122.

The delivery system 114 is armed, i.e., turned on, with a substantial temperature rise in the dryer temperature as recorded by the temperature sensor 122. The temperature rise preferably occurs for a preset number of degrees above an ambient temperature of, for example, 100 degrees Fahrenheit. Typically, the temperature setting is based on the lowest control setting of the three thermostats 124. It is preferred that the rise also be sustained over a predetermined period of time, typically between three to five minutes.

The system is subsequently activated to dispense fragrance onto the product media 112 preferably when a substantial, maintained, temperature decrease of the dryer temperature, as recorded by the sensor 122, occurs. Once the temperature reaches below a certain preset reading, say 120 degrees Fahrenheit, the fragrance is triggered to be dispensed by the delivery system 114.

Variance in the drying cycle, thereby causing false activation of the fragrance dispenser 100, may also be accounted for. One method of accounting for false activation is to build a time duration requirement into the system. For example, an algorithm may be used to make sure the dryer 24 has been running for over thirty minutes before activation of the delivery system can occur.

In an alternative embodiment, the dryer 24 may employ a manual cool-down switch (not shown), wherein the dryer is manually switched to its cool-down phase. In this embodiment, the delivery system 114 may be actuated either automatically in conjunction with the manual cool-down switch, or manually at the same time the operator employs the switch.

As stated above, a product media 112 is positioned in the air intake environment 101 of the dryer 24. The product media 112 is typically positioned so that the plane of the product media is substantially parallel to the direction of airflow through the air vent 104 in the air intake environment 101 (FIG. 11). This positioning is to help ensure that the product media does not obstruct the air flow, for example, if the product media 112 would become covered in lint before it is changed out. The product media, due to this location in the dryer, may be easily accessed for purposes such as changing out or maintenance. The product media 112 may also be positioned in any other suitable position which allows the product media to absorb the fragrance, and the air to pass over it, carrying a sufficient amount of fragrance to the rotating drum 106 of the dryer 24 where the garments are located.

Typically, the product media 112 does not have to be of size such as to embody the entire width of the air vent 104 pathway. It may be any suitable size, such as 4"×4" or 6"×6", to perform as discussed. The product media 112 may be placed in the air intake environment 101, as discussed, in any suitable way, i.e., a standard bracket assembly (not shown).

The product media 112 is typically a mesh-like material, which has sufficient substance to hold the fragrance applied to it, but enough porosity for the air to flow through it. Typically the product media 112 is a synthetic type, such as a cellulosic rayon type, a polypropylene type, or a latex type media, but may be any other suitable material which meets the objectives of the present invention.

The fragrance typically has emulsifiers in it. Therefore, spraying it onto the preferably mesh-like material of the product media 112 allows the emulsifier to accumulate on the mesh-like material, and subsequently for the product media 112 to be changed out when needed.

In an alternative embodiment, the fragrance is sprayed into the air without the use of a product media.

As seen in FIG. 11, the delivery system 114 to apply the fragrance to the product media 112 typically includes a dispensing apparatus 117, preferably an air-injection spray nozzle 115. The delivery system 114 is triggered to dispense the fragrance onto the product media 112. The air-injection nozzle 115 is typically a full cone spray nozzle configured to apply the fragrance to the product media 112. A suitable nozzle for such use is the Spraying Systems Unijet TG spray nozzle. This nozzle sprays at the rate of approximately 2 ml/sec, and atomizes, to a degree, without outside air pressure.

The dosage of the fragrance into the dryer 24 generally depends on the strength of the fragrance itself. The amount of the fragrance to be dispensed can be adjusted accordingly. For example, for the concentrate discussed previously (made-up of 87% water, 3% lemon fragrance, 6% nonylphenol ethoxylate 9.5 mole, 3% nonylphenal 15 mole ethoxylate, and 0.80% alkyl pimethyl benzl ammonium chloride), the recommended range is between 6–10 mls, preferably approximately 8 mls.

The fragrance port 126, where the dispensing apparatus 117 is located, is typically positioned downstream from the burner 103, as discussed above. This positioning allows easy installation of, and access to, the fragrance port 126. Also, the fragrance port 126 is not exposed to the heat of the burner 103 like it would be if it were positioned further inside the flow path of the air intake environment 101 of the dryer 24.

The spray nozzle 115 can be positioned in its desired location in any suitable manner. Typically, the spray nozzle 115 is held in place with a mounting bracket assembly 127, such as that shown in FIG. 11.

The operation of the dryer 24 establishes a vacuum effect to draw the fragrance toward the product media 112 when the fragrance is dispensed. The operation of the dryer 24 also draws air through the product media 112 located in the air intake environment 101 of the dryer, thereby drawing the fragrance into the rotating drum 106 of the dryer 24 where the garments are located.

The application of the fragrance to the product media 112, and not to the garments directly, helps to avoid problems, such as staining of the garments, and inconsistent application. Furthermore, application to the garments at this stage allows application of the fragrance to the garments when the garments are still rotating and warm.

Rather than injection of the fragrance to the product media 112 via an injection nozzle 115, alternative embodiments of a dispensing apparatus 117 exist, as seen in FIGS. 12–15. For example, the fragrance may be injected onto a porous, machined, sintered ceramic 128 for evaporation when triggered to do so. (See FIG. 12 and FIG. 12(*a*)).

Another alternative embodiment is to spray the fragrance with a misting or atomizing nozzle 130. For this embodiment, an additional air source (not shown) is required. The atomizing nozzle 130 sprays an atomized mist of the fragrance into the flow of air when triggered to do so. Generally, a round spray pattern air atomizing nozzle is used. A suitable nozzle for such use is the Spraying Systems SU11 nozzle. (See FIG. 13 and FIG. 13(*a*)).

Another alternative embodiment is to place the fragrance into a piezo electric vibrator 132, which emits a mist of the fragrance. This includes injecting a shot of the fragrance into a chamber of the piezo electric vibrator 132 and a second step of triggering the vibration of the apparatus which will release a mist of the fragrance until the fragrance is fully atomized. (See FIG. 14 and FIG. 14(*a*)).

Figure 15:
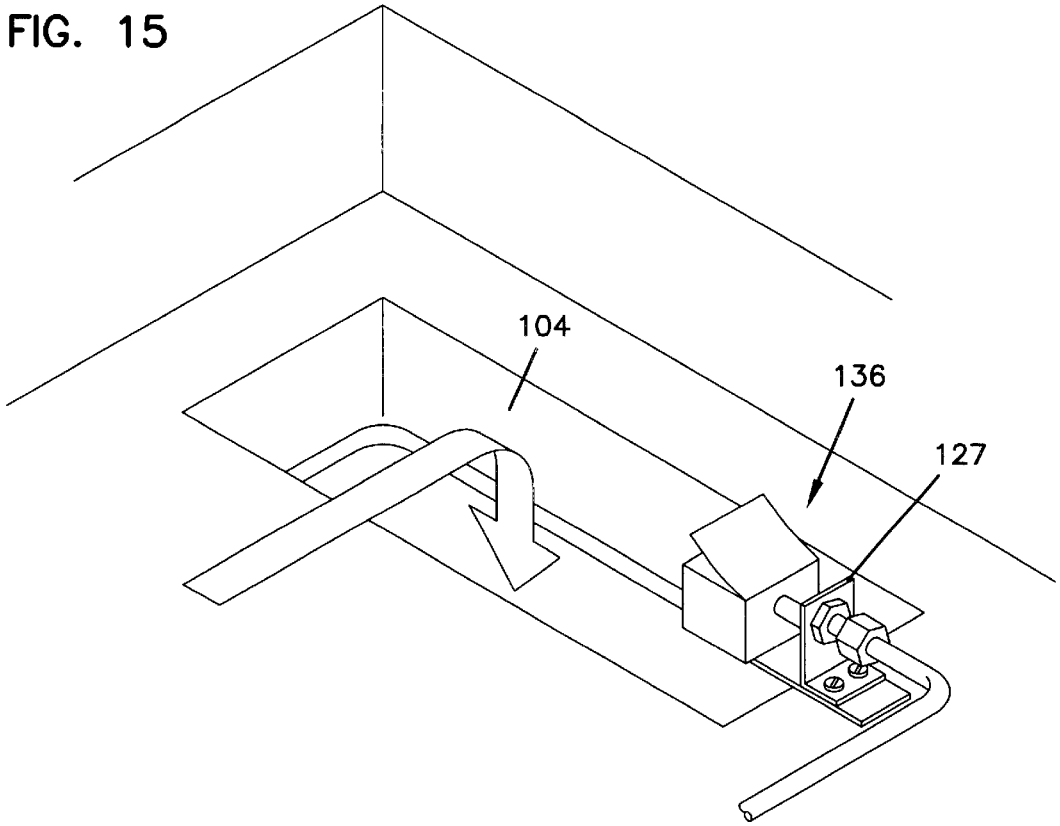
Figure 15A:
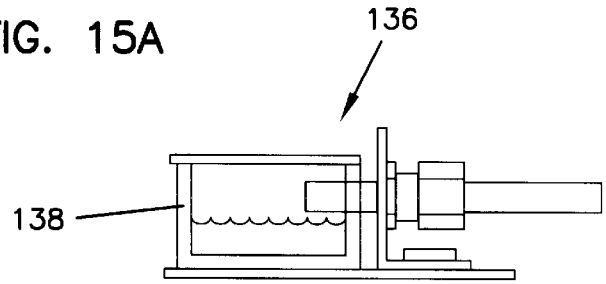
Figure 15B:
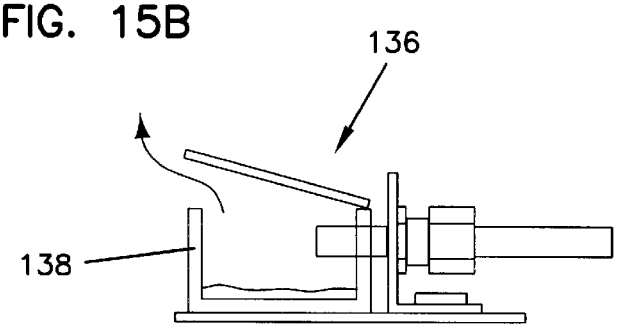

Another alternative embodiment, shown in FIG. 15, is to have a bi-metal strip 136 which is made of a conductive metal or ceramic. Fragrance is injected into the container 138 subsequent to the heat being sensed. The bi-metal strip remains closed while the temperature is rising during the drying process (FIG. 15(*a*)). Then upon the cool-down phase of the drying process, the bi-metal strip 136 will be triggered to open, allowing the fragrance to be dispensed and volatilize (FIG. 15(*b*)).

In an alternative embodiment to the delivery systems mentioned, the fragrance-product may be hand-pumped onto the product media 112 with a hand sprayer. This hand-pumped spray is preferred to take place when the burner 103 is off and the garments have already received maximum heat-treatment.

In use of one possible embodiment, the product media 112 is positioned substantially parallel to the direction of air flow through the air intake environment 101 of the dryer 24. The delivery system 114 is armed when a substantial temperature rise in the dryer temperature, as recorded by the temperature sensor 122, occurs. The delivery system 114 is subsequently activated to dispense fragrance when a substantial, maintained temperature decrease of the dryer temperature occurs. When the temperature reaches below a certain preset reading, the delivery system 114 is triggered to dispense the fragrance.

During the cool-down phase of the dryer, the delivery system 114, which typically includes an air-injection spray nozzle 115 as a dispensing apparatus 117, applies the fragrance to the product media 112. The fragrance is applied from the air-injection spray nozzle 115 to the product media 112 via a vacuum effect created by the air flow of the dryer 24. The operation of the dryer 24 then continues to draw air through the product media 112 containing the fragrance. The fragrance reaches the garments located in the rotating drum 106 of the dryer 24.

A concentrate is diluted to form the fragrance which is finally applied to the product media 112. Diluting the concentrate includes drawing a diluent through a venturi in fluid communication with the source of concentrate.

While the system and method hereinbefore described is effectively adapted to fulfill the aforesaid objects, it is to be understood that the invention is not intended to be limited to the specific preferred embodiments of the fragrance dispenser apparatus and methods set forth above. Rather, it is to be taken as including all reasonable equivalents to the subject matter of the appended claims.

We claim:

1. A laundering apparatus comprising:

a.) a washer for washing fabric to provide washed fabric;

b.) a dryer with an air intake environment for drying the washed fabric by application of heated air to provide dry fabric;

c.) a fragrance dispenser for automated application of fragrance to the dry fabric, the fragrance dispenser comprising a sensor, a fragrance delivery system, and a fragrance reservoir;

d.) the sensor being provided for sensing conditions desirable for delivery of fragrance to the dry fabric and activating the fragrance delivery system to dispense fragrance from the fragrance dispenser, wherein the fragrance delivery system is in fluid communication with the fragrance reservoir;

e.) the fragrance delivery system being provided for delivering a predetermined amount of fragrance from the fragrance reservoir to the dry fabric; and f.) the fragrance dispenser is positioned to dispense fragrance to fabric by at least one of:

(i) application of fragrance to the fabric when the fabric is provided outside the dryer; and (ii) application of fragrance to the air intake environment of the dryer when the fabric is provided inside the dryer.

2. The apparatus of claim 1 wherein the fragrance dispenser is positioned to dispense fragrance to the air intake environment when the fabric is provided inside the dryer.

3. The apparatus of claim 2 further comprising:

a product media located in the air intake environment of the dryer; and wherein the delivery system is configured to apply fragrance to the product media.

4. The apparatus of claim 3 wherein the delivery system is configured to apply fragrance to the product media during a cooling cycle of the dryer.

5. The apparatus of claim 3 wherein the product media is positioned so the plane of the product media is substantially parallel to the direction of air flow through the air intake environment of the dryer.

6. The apparatus of claim 5 further comprising a diluting system in fluid communication with the delivery system and the fragrance reservoir.

7. The apparatus of claim 6 wherein the fragrance reservoir contains a concentrated product, and wherein the diluting system dilutes the concentrate with a diluent.

8. The apparatus of claim 7 wherein the diluent is water.

9. The apparatus of claim 8 wherein the diluting system comprises a venturi.

10. The apparatus of claim 3 wherein the delivery system comprises an air-injection spray nozzle.

11. The apparatus of claim 10 wherein the air-injection spray nozzle is configured to apply fragrance to the product media.

12. The apparatus of claim 3 wherein the dryer establishes a vacuum to draw the fragrance toward the product media.

13. The apparatus of claim 2 wherein the delivery system comprises a porous ceramic onto which the fragrance is injected and subsequently triggered to evaporate therefrom.

14. The apparatus of claim 2 wherein the delivery system comprises a misting or atomizing nozzle which sprays an atomized mist of the fragrance into the air flow when triggered to do so.

15. The apparatus of claim 2 wherein the delivery system comprises a piezo electric vibrator which emits a mist of the fragrance stored in its chamber.

16. The apparatus of claim 2 wherein the delivery system comprises a bi-metal strip having a container into which fragrance is injected and subsequently released when the container is triggered to open.

17. The apparatus of claim 2 wherein the sensor senses the temperature of the dryer.

18. The apparatus of claim 17 wherein the delivery system is armed when the sensor senses a predetermined increase in temperature of the dryer.

19. The apparatus of claim 18 wherein the delivery system is activated when the sensor senses a predetermined decrease in temperature of the dryer, and the delivery system is triggered to dispense fragrance when the temperature of the dryer reaches below a preset reading.

20. The apparatus of claim 1 wherein the fragrance dispenser is positioned to dispense fragrance to fabric outside the dryer.

21. The apparatus of claim 20 wherein the delivery system comprises a spray nozzle.

22. The apparatus of claim 21 wherein the spray nozzle is configured to apply fragrance to the fabric.

23. The apparatus of claim 22 wherein the sensor senses the presence or absence of a fabric.

24. The apparatus of claim 23 wherein the presence of a fabric triggers the delivery system to apply fragrance to the fabric.

25. The apparatus of claim 20 wherein the fragrance dispenser comprises a counting mechanism to track the number of sprays by the delivery system.

26. The apparatus of claim 20 wherein the delivery system further comprises a timing device for dispensing the fragrance onto the fabric for a controlled amount of time.

27. A method of automated application of fragrance to dry fabric during a laundering process, the method comprising:

a.) washing fabric by application of aqueous detergent to provide washed fabric;

b.) drying the washed fabric in a dryer by application of heated air through an air intake environment to provide dry fabric;

c.) applying fragrance to the dry fabric, the application operation comprising sensing conditions for delivery of fragrance to the dry fabric and activating a delivery system, the fragrance being applied to the fabric by at least one of:

(i) applying the fragrance to the fabric when the fabric is provided outside the dryer; and (ii) applying the fragrance to the air intake environment when the fabric is provided inside the dryer; and d.) delivering from the delivery system a predetermined amount of fragrance from a fragrance reservoir to the dry fabric.

28. The method of claim 27 wherein applying fragrance to the dry fabric occurs during the drying operation when the fabric is provided inside the dryer.

29. The method of claim 28 wherein applying fragrance to the dry fabric is performed during a cooling cycle of the dryer.

30. The method of claim 29 wherein the sensing operation comprises providing a sensor to sense the temperature of the dryer for the purpose of arming, activating, and triggering the delivery system.

31. The method of claim 30 further comprising:

drawing air through a product media located in the air intake environment of the dryer; and applying the fragrance for treating fabric to the product media.

32. The method of claim 31 wherein the product media is positioned so the plane of the product media is substantially parallel to the direction of air flow through the air intake environment of the dryer.

33. The method of claim 32 wherein the fragrance is applied to the product media via an air-injection spray nozzle.

34. The method of claim 32 wherein the fragrance is applied to the product media via a vacuum effect.

35. The method of claim 30 further comprising:

diluting a concentrate to form the fragrance.

36. The method of claim 35 wherein the step of diluting further comprises drawing a diluent through a venturi in fluid communication with a source of concentrate.

37. The method of claim 30 wherein the fragrance is applied to the fabric via a porous ceramic.

38. The method of claim 30 wherein the fragrance is applied to the fabric via a misting or atomizing nozzle which sprays an atomized mist of the fragrance into the air flow.

39. The method of claim 30 wherein the fragrance is applied to the fabric via a piezo electric vibrator which emits a mist of the fragrance stored in its chamber.

40. The method of claim 30 wherein the fragrance is applied to the fabric via a bi-metal strip having a container into which fragrance is injected and subsequently released when the container is triggered to do so.

41. The method of claim 27 wherein applying fragrance to the dry fabric occurs when the fabric is provided outside the dryer.

42. The method of claim 41 wherein the sensing operation comprises providing a sensor to sense the presence of a fabric passing by the delivery system.

43. The method of claim 42 wherein the delivery operation is triggered by the sensing of fabric.

44. The method of claim 43 wherein the fragrance is applied to the dry fabric via a spray nozzle.

45. The method of claim 41 wherein the delivery system is in fluid communication with the fragrance reservoir.

46. The method of claim 41 wherein the delivery operation comprises providing a timing device for dispensing the fragrance onto the fabric for a controlled amount of time.

47. The method of claim 46 wherein the delivery operation comprises providing a counting mechanism to track the number of sprays by the delivery system.

* * * * *